United States Patent [19]

Skipper

[11] Patent Number: 5,014,780

[45] Date of Patent: May 14, 1991

[54] LONG DISTANCE SECTION MILL FOR PIPE IN A BOREHOLE

[76] Inventor: Uvon Skipper, 7409 S. Rice Ave., Bellaire, Tex. 77401

[21] Appl. No.: 518,133

[22] Filed: May 3, 1990

[51] Int. Cl.[5] ..... E21B 29/00

[52] U.S. Cl. ..... 166/55.8; 175/406

[58] Field of Search ..... 166/55.8, 55.7, 55.6, 166/55.3, 55.2, 55, 361, 317, 318; 175/384, 406, 267, 269, 286

[56] References Cited

U.S. PATENT DOCUMENTS

| | | | |
|---|---|---|---|
| 1,283,969 | 11/1918 | Tertrou | 166/55.8 |
| 1,529,848 | 3/1925 | Reeder | 166/55.8 |
| 1,772,710 | 8/1930 | Denney | 166/55.8 |
| 2,112,026 | 3/1938 | Jones | 166/55.3 |
| 2,353,284 | 7/1944 | Barrett | 166/55.8 |
| 2,481,637 | 9/1949 | Yancy | 166/55.8 X |
| 2,863,511 | 12/1958 | Moosman | 166/317 |
| 3,316,970 | 2/1967 | Huitt et al. | 166/55.7 |
| 4,427,070 | 1/1984 | O'Brien | 166/317 |
| 4,893,675 | 1/1990 | Skipper | 166/55.8 |

*Primary Examiner*—Hoang C. Dang

*Attorney, Agent, or Firm*—Gunn, Lee & Miller

[57] ABSTRACT

A milling apparatus is disclosed. The structure includes first and second upper subs threading together and having an inner axial passage. A long stinger fits in this passage and connects with a mandrel which is telescoped within an outer tubular body for a vertical or telescoping movement. The mandrel is formed with lengthwise slots, enabling independent knives to be positioned in each of the slots. The knives are engaged for controlled radial deflection by a dovetail connection, and the slots terminate at a sloping shoulder to force the individual cutters radially outwardly. An expansion chamber below the mandrel forces the mandrel upwardly with respect to the surrounding outer tubular body, causing the cutters to extend through individual lengthwise slots in the outer tubular body to the cutting position.

9 Claims, 2 Drawing Sheets

LONG DISTANCE SECTION MILL FOR PIPE IN A BOREHOLE

BACKGROUND OF THE DISCLOSURE

The present disclosure is directed to a milling machine for milling long sections from a cased well. It particularly finds application were a well has been operated for a substantial period of time at a specified depth and is ultimately depleted so that reentry is necessary. It is especially helpful where reentry and recompletion involves horizontal drilling, namely, deviation of the well from the original vertical course of the well. Briefly, consider as an example a well that is extended into a particular formation at a depth of 8,000 feet. Assume that the formation production slumps, and becomes unprofitable. Assume further that the formation is known to be a productive formation. In this instance, it is desirable to extend the well to another portion of that same formation. This can be accomplished by well reentry above the formation, drilling on a curvature to reenter the formation with a well segment which is approximately horizontal. To do this, the well must be reentered a few hundred feet above the formation, and that typically requires cutting away a portion of the casing that was placed in the well to the depth of 8,000 feet or greater. In that instance, reentry must begin by cutting away the casing so that drilling through the sidewall can be accomplished after the subsequent recompletion process begins with removal of a window of the casing. Sometimes, two or three hundred feet of the casing must be removed. Practically speaking, the only process for removal is cutting it away in the fashion of milling. Milling machines are known. The present apparatus, however, is an improved miller which enables the milling of several hundred feet, perhaps two or three hundred feet of casing, and this can be done by operating in a continuous fashion. It enables longer knives to be used, permitting greater wear on the knives, and thereby reducing trips into the well to service the cutter mechanism. It is operated in response to pressure in the drill string. Moreover, it provides a set of knives which extend radially outwardly, thereby enabling the tool to enter through a relatively narrow previously cased well.

On the latter point, consider the typical dimensions. When the well is first drilled, it typically will be drilled with a drill bit forming a hole of perhaps seven and one half inches or larger diameter. Subsequently, a casing string will be placed in the well and cement will be placed in the annular space on the exterior of the casing. This will leave an internal passage through the casing which is much smaller, perhaps in the range of about five inches diameter. When a reentry program is initiated, the milling device must be lowered on a string of drill pipe where all this equipment fits within the cased well. In other words, clearance is tight, and the room necessary for easy rotation during drilling procedures at reentry is very snug.

To this end, the present apparatus provides a milling device which has retracted knives which are not extended until they are at the depth in the well where extension is necessary. It is extremely helpful to have this improved clearance tool so that reentry at great depths can be accomplished. Reentry is thus initiated by milling a long window in the casing. In this particular instance, the present invention enables reentry and cutting of a long window, even as long as three hundred feet. Typically, this can be accomplished with a single trip into the well after cut out is first made thereabove.

The present apparatus is thus a milling device which includes an elongate outer body. There is an internal mandrel within the body and it is mounted for movement between upper and lower positions. The mandrel is positioned adjacent to and beneath a set of knife blades. The knife blades are mounted so that they can extend radially outwardly. They have a first position where the knife blades are retracted; alternately, they are extended by upward movement of the mandrel. The mandrel is forced into the operative position, causing knife blade extension, by application of increased pressure in the drill string. The tool incorporates a drill string pressure fluid receiving chamber, and the chamber, on expansion, forces the mandrel to move upwardly. The mandrel in constructed with an external surface including an enlarged shoulder which slides under or beneath the set of knife blades, forcing them radially outwardly and moving the knife blades into a cutting position.

The present apparatus further is able to thereafter begin milling, and to mill the casing by continuous rotation of the drill string. This can continue as long as required so that the casing is removed for a designated length. It is not uncommon to require a milled window of three hundred feet in length. If the number of trips can be reduced by the use of the present invention, a very desirable result is accomplished, namely, the milling process can be accomplished much more rapidly.

The present disclosure sets forth an apparatus which threads to the lower end of a drill string to fit within a cased hole. It incorporates a top sub for connection with the drill string. A drain sub is threaded to that and supports an internal drain sleeve. A circulating port connects through the two of these to an internal axial passage. A drain plug fits in the axial passage and has a narrow passage therethrough, and is attached by means of a shear pin. The drain sub is activated only if the tool cannot retract the knives, after milling, with ordinary procedures. When the drain sub plug shears, it opens ports for circulation, and also pushes the piston into the relaxed position. This can be sheared on dropping a sphere into the drill string for closure purposes. The drain sub connects with a surrounding outer body extending therebelow. That encloses a telescoped mandrel. The mandrel connects with the axial passage, has a protruding stinger, and defines an axial passage the full length of the mandrel to a chamber at the lower end of the mandrel. This chamber serves as a fluid expansion chamber. When fluid is introduced into this chamber under pressure, it forces the mandrel upwardly. This chamber is selectively connected to the exterior by means of matching ports which align on upward movement of the mandrel so that fluid can flow into the chamber and into the annular space on the exterior of the tool for flowing upwardly to wash cuttings away from the knives. There is an annular space around the mandrel located within the outer body to receive a set of knives, and the knives extend radially outwardly when the mandrel moves upwardly. The knives are supported for movement outwardly. At the front end of the knives, they are guided by a dovetail arrangement to direct the knives outwardly. The mandrel is provided with changes in diameter defining a set of slots or steps which guide the back ends of the respective knife blades. This extends the knife blades outwardly and locks them so that they are held radially outwardly for cutting exteding through ports or slots formed in the tubular outer body. This operates based on a shoulder means forcing the knives radially outwardly in response to upward movement of the mandrel.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
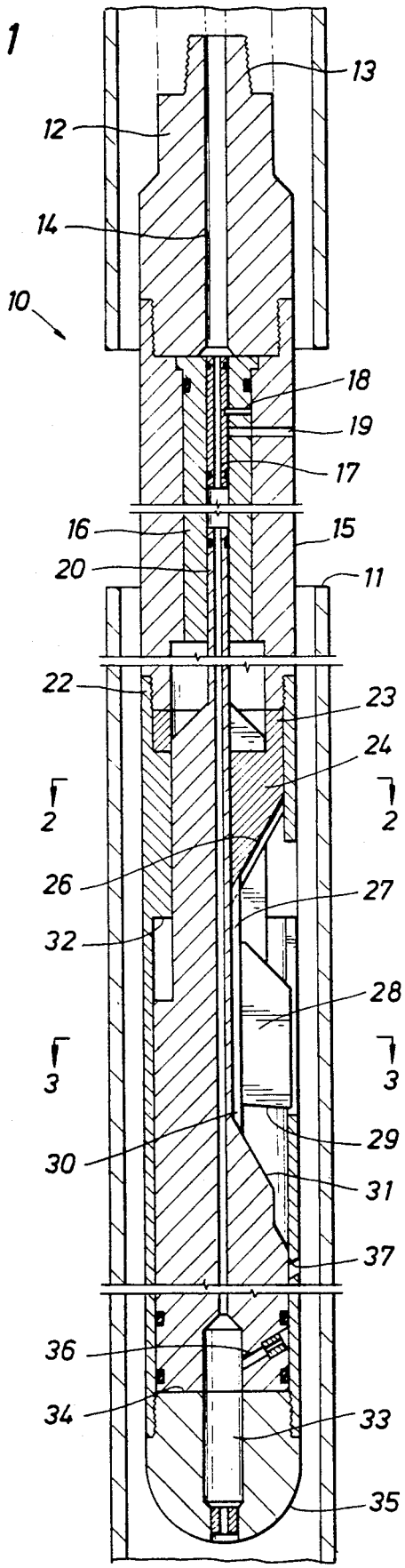
FIG. 1 is a lengthwise sectional view through the tool of the present disclosure showing a retracted set of knives which extend radially outwardly on axial movement of a mandrel within the outer body, and which are shown retracted for running in a cased well.

The present apparatus is identified generally by the numeral 10 in FIG. 1 of the drawings. There, it is shown on the interior of a casing 11 which has been cemented in a well borehole. The casing 11 typically is positioned in a well when the well is first completed and it normally is removed months or years later to complete a reentry into the well to redrill at least a portion of the well to enhance production. The retractable milling apparatus of the present disclosure 10 is run into the well on a drill string and is operated to cut the casing 11 of several hundred feet in length. It is first positioned in the well by running it into the well on the drill string from the well head with retracted knives as will be apparent from the discussion. The window is cut in the casing 11 which has been illustrated without surrounding cement or adjacent formations for clarity.

Considering the milling apparatus 10 from the top end, there is a top sub 12 which is threaded at 13 for joinder with a string of drill pipe. An axially hollow passage 14 provides a path for mud flow. The top sub threads to a drain sub 15 which extends the tool at a common external diameter. The sub 15 encloses and surrounds a drain sleeve 16 which is axially hollow along its length. It is fixedly joined by a locking shoulder to the surrounding sub. It is axially hollow and the upper end thereof encloses a drain plug 17 which is also axially hollow. That is held in position by a shear pin 18 which can be sheared for reasons to be described. When sheared, it is forced downwardly by pressure. This downward movement exposes a circulating port 19. The port 19 extends laterally to the exterior so that a circulation path is defined through the top sub and to the exterior. The purpose of this circulating port and this optional flow path will be explained later.

A long stinger 20 is located in the axial passage in the drain sleeve 16. This stinger is able to telescope upwardly and downwardly. With appropriate seals at the upper end, it defines an exclusive flow path to the bottom of the tool as will be described. The stinger 20 is a centralized appendage to the mandrel 21 also shown in FIG. 2 of the drawings. The mandrel has a fairly large diameter as shown at the left side of FIG. 1, but it is formed with lengthwise slots as shown on the right side of FIG. 1. The slots align with the knife blades to be described.

Figure 2:
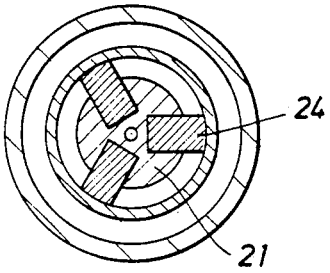
FIG. 2 is a sectional view along the line 2—2 showing details of construction of the guide mechanism which stabilizes the knives in the retracted position.
Figure 3:
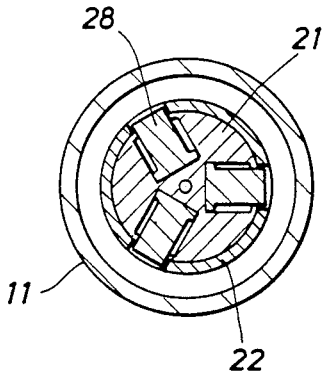
FIG. 3 is a sectional view along the line 3—3 of FIG. 1 showing details of construction of several knives which retract or extend radially outwardly operating with slots in the mandrel and surrounding outer body.
Figure 4:
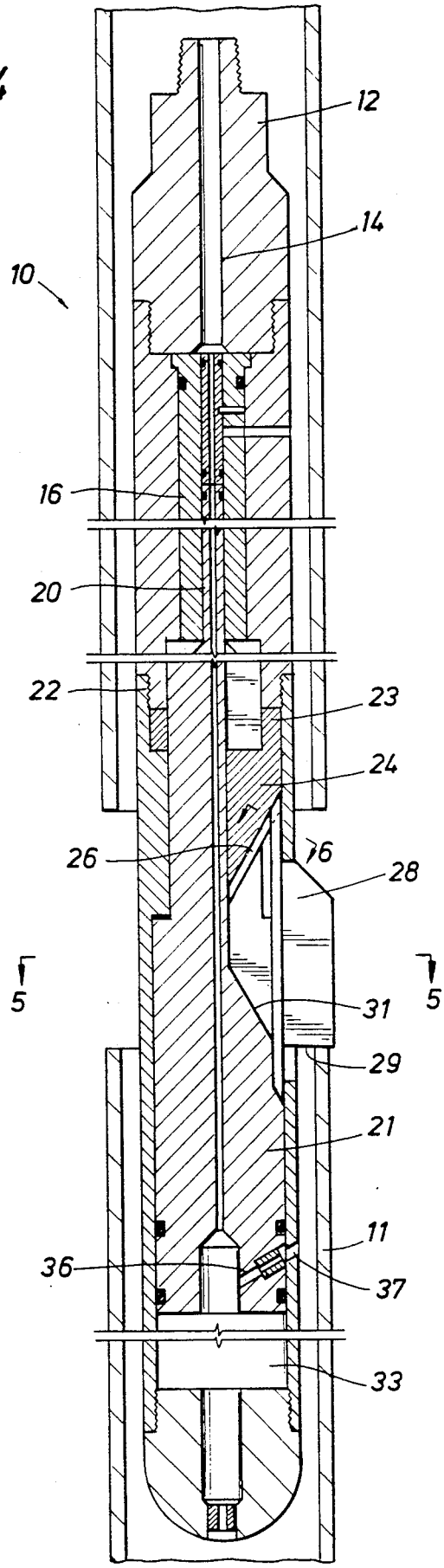
FIG. 4 is a view similar to FIG. 1 which shows the mandrel in the raised position forcing the cutting knives outwardly.

The drain sub is fixed in location. It terminates at an external thread on an appended skirt, thereby threading to an axially hollow elongate tubular outer body 22. In addition, a ring 23 is located on the interior and abuts the skirt at the bottom end of the drain sub. This skirt supports a thin platelike appendage which extends into the slot, the appendage or plate 24 being constructed with a wedge-shaped lower shoulder. As shown in FIG. 1, the appendage 24 is a wedge cooperative with the knife blade therebelow for extension of the knife blade. The wedge 24 is shown in FIG. 2 in the retracted position, and this further shows how duplicate wedges are located in the respective slots around the mandrel 21. The mandrel is guided so that rotational movement is forbidden. Telescoping movement upwardly as shown in FIG. 1 is permitted. When this occurs, the stinger 20 moves upwardly as shown in FIG. 4. Likewise, the mandrel 21 moves upwardly so that the wedge 24 relatively moves down to contact the knives. The narrow slots enable the wedge 24 to ride under its respective knife to cause extension. The wedge 24 has a lower tapered face which is constructed with a dovetail 26 shown in FIG. 6 of the drawings. This dovetail guides the knife during extension or retraction. The knife is constructed in the form of a guide tip 27 which extends parallel to the mandrel slot. In addition to this, the knife construction includes the blade 28 which extends radially outwardly. It is constructed with a cutting edge 29 at the lower end of the blade. The blade is mounted so that it is free to wobble left and right but it does not wobble because it fits snugly in the slot or groove along the mandrel 21. This is especially evident in FIG. 3. There, the blade is shown mounted in the radial slot so that wobble is prevented. The blade 28 incorporates a lower tip 30 which rides over the shoulder 31 which terminates the back end of each of the several slots in the mandrel. The shoulder 31 forces the blade radially outwardly. When this movement occurs, the top end of the blade is guided by the cooperative dovetail connection at 26. This enables the blade 28 to extend out from the surrounding tubular hollow body at the lower end of the milling apparatus 10. Since the apparatus includes three such blades, three separate cutters are presented adjacent to the top end of the casing 11 so that it is cut or milled away. The three cutting edges 29 accomplish milling of the full length window to be cut in the previously cased well.

The surrounding outer tubular body includes a downwardly facing shoulder 32 which defines the limits of upward travel for the mandrel 21. The mandrel 21 moves upwardly jointly moving the stinger 20 upwardly to direct flow along the mandrel. This flow path extends to the lower end of the tool. A chamber 33 is defined by lower terminal face 34 of the mandrel. The chamber 33 is a fluid expansion chamber. Fluid is directed into this chamber to cause expansion. The chamber is defined by a streamlined spherical end 35 which encloses the chamber, and there is additionally a fluid flow path out of the chamber 33. This flow path is through a flow orifice 36 which extends upwardly at an angle and is aligned with a port 37 at the top end of travel of the mandrel. The flow orifice 36 delivers fluid into the annular space surrounding the tool exterior so that fluid flows upwardly to flush away cuttings. The fluid flow is directed upwardly around the knife blades. The fluid outlet 37 is located so that fluid communication to it is denied when the mandrel is in the down position. When the mandrel telescopes upwardly (contrast FIG. 2 with FIG. 1), fluid communication is perfected. The flow orifice 36 is isolated by surrounding upper and lower O-rings. Ideally, the orifice 36 is provided with two or three duplicate passages, and the port 37 is likewise duplicated at two or three locations. The chamber 33 is optionally axially partially voided through a downwardly directed orifice so that some flow is below the tip of the tool 10.

MANDREL MOVEMENT AND COOPERATIVE KNIFE EXTENSION

Attention is directed next to FIG. 4 of the drawings. There, the stinger 20 is in the raised position because the mandrel 21 has been forced upwardly. This movement is accomplished by expansion of the chamber 33 in response to fluid delivered into this chamber. The chamber 33 is shown expanded, and the fluid flow route just mentioned is operatively connected to introduce annular fluid flow around the tool to flush this region of the knives. FIG. 4 further shows the knife 28 extended. There, it will be noted that the shoulder 31 (in the lengthwise slot) has cooperated with the knife 28 to force it radially outwardly. Knife extension is accomplished by upward movement of the shoulder 31 as noted. The knife 28 is guided in movement by the cooperative dovetail 26 mentioned. This movement is accomplished on upward travel of the mandrel, causing the knife to be guided radially outwardly. While there is some telescoping movement of the knife blade 28, this movement assures a smooth knife transition from the retracted position of FIG. 1 to the extended position of FIG. 4.

Relative scale of the apparatus should be considered, particularly the extension of the blades as shown in FIG. 4. They are extended to a length so that the casing 11 is completely milled away. If needed, the blade can extend farther to assure cutting of the entire casing and cutting of a portion of the surrounding cement which holds the casing in place. In any event, the extended knife blades are sized so that they will cut the entire casing. This cutting process begins by first forming a cut (with a cutting type section mill) in the casing to remove a short portion of casing. The milling apparatus 10 is lowered to the location below this cut. Fluid pressure is delivered through the drill string, expanding the chamber 33 and causing the mandrel to move upwardly. This forces the knife blades radially outwardly. The tool is preferably pulled upwardly and the knife blades move outwardly when freed of the constraint of the surrounding snug casing. In other words, the snug fit forces the blades to a partially retracted position. When full extension occurs, a shift in flow rate is noted at the surface because the flow orifice 36 begins delivery of fluid into the annular space. Volume flow increases and the back pressure cause by the tool in the system will drop. This assures as adequate cooling and lubricating flow past the knives. In any event, the knives extend radially outwardly and are positioned for cutting. Cutting is accomplished by rotation of the drill string imparted from the surface. Cutting proceeds so long as rotation is continued. The rate of cut is in part dependent on the rate of penetration of the knife blades into the casing 11. In turn, that depends in part on the rotary speed and speed of advancement. It is possible to mill away great lengths of casing including casing collars and the like. This milling process continues until the window of suitable length has been cut. For instance, it is not uncommon to require milling of a window which is perhaps two hundred feet in length, or sometimes even as long as three hundred feet.

Attention is directed again to the top portions of FIG. 1. This shows a circulating port, but it is blanked by the drain plug which is on the interior. the drain plug, however, can be knocked loose. If the situation requires enhanced circulation through the tool, a small sphere is dropped in the string of drill pipe and ultimately lands in the top sub passage 14 and plugs the drain plug. When this occurs, the pump pressure at the surface will kick, indicating blockage. Pressure is then increased sufficiently that the shear pin 18 is broken. The shear pin will break, releasing the drain plug for downward movement. This downward movement is sufficient to expose the circulating port and direct fluid flow to the exterior from the near top portions of the tool. This is involved in the tool release procedure.

Retrieval of the present apparatus is easily achieved. It is achieved simply by lifting up on the string of drill pipe that supports the tool, and reducing pressure of the drilling fluid in the drill string. Pressure drop in the drill string permits the chamber 33 to be reduced in size. Indeed, the mandrel 21 telescopes downwardly. When it does, the shoulder 31 at the bottom end of the knife is pulled away while the wedge at the top end relatively remains primarily for the purpose of guiding the knife blade in retraction. Upward movement against any kind of fluid resistance, or snagging on any protrusion in the casing deflects the separate and independent knife blades 28 downwardly. Downward movement is accompanied with retraction, and when retraction occurs, the blades are pulled out of engagement with the casing 11 and are retracted ultimately to the full line position of FIG. 1. At this time, rapid retrieval from the cased well can be undertaken.

Figure 5:
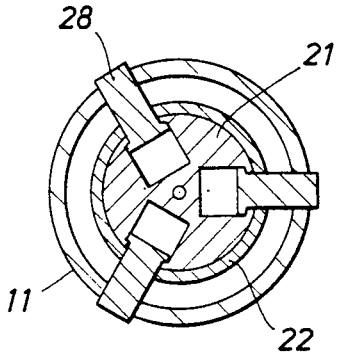
FIG. 5 is a view along the line 5—5 of FIG. 4 showing deployment of the knives radially outwardly for cutting the surrounding cased well.
Figure 6:
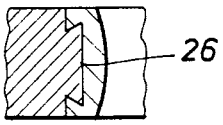
FIG. 6 is a sectional view across the dovetail which supports the knife blades for retraction and extension.

One important feature of the present disclosure is the shape of the cutter blades which assists in providing a long operating life. Specifically, the cutter blades are constructed with helpful features which keep the blades engaged with the structure to avoid chatter and excessive wear resulting from chatter. First of all, FIG. 6 shows the dovetail arrangement 26 at the forward or top end of the cutter blades. The dovetail provides positive guidance so that each cutter blade makes a guided transition from the retracted position of FIG. 1 to the extended and cutting position of FIG. 4. This guidance occurs from the front or top end of the cutter blade, and is a positive mode of engagement so that blade stability is assured. In addition to that, the cutter blades are recessed in slotted lengthwise cavities as shown in the sectional views of FIGS. 3 and 5. The blades are retracted in FIG. 3 and extended in FIG. 5. The blades are provided with an inverted Tee so that interlocking lips or shoulders extend along the lengthwise edges of the blades. In the extended position of FIG. 5, the blades nest up against the overhang so that they are locked in the slots. So to speak, the supportive slots for the blades are undercut to define left and right edge located overhanging interlocking lips. This assures that the blades are held with maximum supportive contact. This maximum contact assists in preventing chatter, wobble and premature wear.

Another factor that is important to the extension of the blades is the tapered back face 31 which assists in cutter blade extension. When the blades extend, they are held by the dovetail engagement at the forward end of each blade, discussed above, and they are additionally held by the lengthwise side located interlocks just mentioned. This enhances blade stability during machining. Moreover, this enhances operation of the device so that cutter blade wear and tear is extended to the maximum life.

In summary, the present apparatus is especially adapted for milling long distances. It is provided with separate and independently extended, independently replaced knife blades which are substantial so that substantial wear can be tolerated in use. Moreover, the tool is assembled in such a fashion that knife blade replacement can be easily accomplished at the surface. Disassembly is accomplished probably prior to each and every use of the tool because this assures that a full width, unused knife blade is installed. This helps the tool to stay engaged for longer periods of time. In other words, the continual engagement necessary for operation to assure cutting of the full length of the hundreds of feet in the casing window is then obtained.

While the foregoing is directed to the preferred embodiment, the scope thereof is determined by the claims which follow.

What is claimed is:

1. A miller for lowering into a cased well for milling a casing from the well, the miller comprises:

(a) an elongate outer tubular body having an inner axial passage therealong and adapted to be connected at the upper end thereof to a pipe string in the casing for rotation and cutting the casing;

(b) a movable inner mandrel within said outer body, said inner mandrel movable between an initial position in said outer body and an operative position relative to the initial position therein;

(c) radially extending cutters moveably mounted relative to and extending from said outer body and having cutting edges for contact against surrounding casing wherein said cutters are constructed for cutting the casing on rotation of said outer body with the pipe string;

(d) shoulder means movable with said inner mandrel for operatively moving said cutters radially outwardly into a cutting position;

(e) chamber means within said outer body and having an extension volume located to relatively move said mandrel to operate said shoulder means with said cutters for moving radially outwardly for cutting of the casing in the well on rotation of the miller;

(f) wherein said inner mandrel is positioned for telescoping movement within said outer tubular body and includes lengthwise slots formed therealong wherein said slots receive said cutters therein for radial movement outwardly, and said slots include means slideably engaging said cutters wherein said means comprises an interlocking dovetail connection; and (g) wherein said slots include a shoulder comprising said shoulder means for individually yet jointly moving said cutters to the radially outwardly extending position.

2. The apparatus of claim 1 wherein said cutters have a downwardly facing cutting edge, and said cutters are laterally supported against wobble in said slots lengthwise in said mandrel.

3. The apparatus of claim 1 wherein said chamber means comprises an expandable chamber adjacent to said mandrel at the lower end thereof and said chamber has a specified cross-sectional area defined by said mandrel, and further including a fluid flow passage out of said chamber means rendered inoperative when said mandrel is in the down position and rendered operative to deliver fluid therethrough when said mandrel is in the up position causing radial extension of said cutters.

4. The apparatus of claim 1 wherein said chamber means comprises an expandable chamber adjacent to said mandrel at the lower end thereof and said chamber has a specified cross-sectional area defined by said mandrel, and further including a fluid flow passage out of said chamber means rendered inoperative when said mandrel is in the down position and rendered operative to deliver fluid therethrough when said mandrel is in the up position causing radial extension of said cutters.

5. The apparatus of claim 4 wherein said outer tubular body includes a wall defining an internal chamber and said chamber includes an encircling shoulder abutting said mandrel.

6. The apparatus of claim 5 wherein said mandrel abuts said shoulder at the lower end thereof, and said mandrel also includes a fluid flow passage opening at said shoulder to introduce fluid under pressure from a pipe string, and further including a set of fluid seals preventing leakage from said chamber.

7. The apparatus of claim 1 including an upper sub threadedly joined to a second sub and comprising the upper portions of said elongate outer tubular body and further including an inner axial passage therealong having an upwardly facing transverse shoulder within said outer tubular body, said passage and said shoulder defining a region for receiving means blocking fluid flow along said passage, and further including a shear pin joined to upper sub and arranged to be overcome by the application of elevated pressure through a pipe string wherein the pressure is delivered to said upper sub and through said inner axial passage.

8. The apparatus of claim 1 wherein said cutters are formed of independent, spaced knives and each thereof is received in a lengthwise slot along said mandrel and has a fully retracted position and a fully extended position out of said slots, and further wherein said chamber means is located below said mandrel and said inner axial passage extends to said chamber means for providing fluid under pressure through a pipe string, and including a fluid flow path from said chamber means controlled by a valve means to prevent opening except when said cutters are radially outwardly extended.

9. The apparatus of claim 1 wherein said cutters include:

(a) an exposed cutting edge;

(b) a forward positive engagement means supported by said inner mandrel engaging said cutters wherein said means permits limited movement of said cutters in a radially extending direction only; and (c) cutter locking means including means cooperative with said inner mandrel and said cutters to lock said cutters when extended radially so that locking occurs along opposite sides of said cutters to thereby provide improved stability when said cutters are extended radially from said inner mandrel.

* * * * *